United States Patent [19]

Kern

[11] 4,024,423

[45] May 17, 1977

[54] ELECTRIC DISCHARGE TUBE HAVING VARIABLE ELECTRODE AREA

[75] Inventor: Edmund R. Kern, Hampton, N.H.

[73] Assignee: North American Philips Corporation, New York, N.Y.

[22] Filed: Oct. 6, 1975

[21] Appl. No.: 619,956

[52] U.S. Cl. ..... 313/147; 313/151; 313/217; 313/492

[51] Int. Cl.[2] ..... H01J 1/02

[58] Field of Search ..... 313/214, 217, 146, 147, 313/151, 491, 492

[56] References Cited

UNITED STATES PATENTS

| | | | |
|---|---|---|---|
| 3,213,318 | 10/1965 | Glenn, Jr. | 313/151 |
| 3,226,597 | 12/1965 | Green | 313/151 |

*Primary Examiner*—Rudolph V. Rolinec
*Assistant Examiner*—Michael J. Tokar
*Attorney, Agent, or Firm*—Frank R. Trifari; George B. Berka

[57] ABSTRACT

An electric discharge tube comprising wire probes located close to the electrodes for collecting electrons, and bimetallic support for each wire probe to vary in response to operative temperature, the distance of the wire probe from the electrode.

2 Claims, 2 Drawing Figures

ELECTRIC DISCHARGE TUBE HAVING VARIABLE ELECTRODE AREA

This invention relates generally to gas or vapor discharge lamps such as high current fluorescent lamps. More particularly, this invention relates to discharge lamps having wire probes electrically connected to and located in proximity to each electrode to increase anode area during positive potential on the electrode and to act as a collector of electrons.

The disadvantage of conventional wire probes, however, is in fact that the increased electrode area makes the starting of the tube more difficult.

It is, therefore, an object of this invention to allow easier starting for vapor discharge lamps having electron collecting wire probes.

According to this invention, the above object is obtained by providing wire probes which are mounted close to each electrode and electrically connected thereto, and by supporting each wire probe on a bimetallic lead or strip which is adjusted in its cool condition for placing the wire probe in a starting position remote from the electrode and upon ignition of the discharge tube, in an operative position close to the electrode.

An embodiment of the invention will now be described, by way of example, with reference to the accompanying drawing in which.

Figure 1:
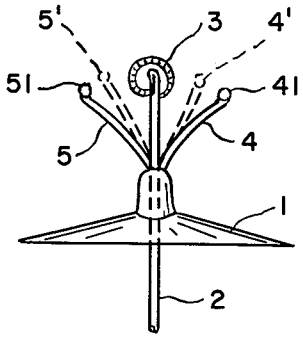
FIG. 1 is an elevation view of a mount at one end of a discharge lamp.
Figure 2:
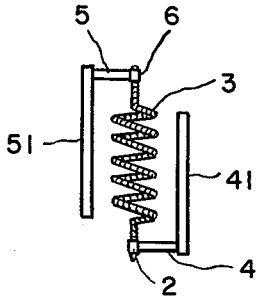
FIG. 2 is a top view of the electrode as shown in FIG. 1.

Referring now to the figures, a glass mount 1 supports lead-in wires 2 and 6 which in turn support a spiral electrode 3 of a cathode emitter material. Two wire probes 41 and 51 are electrically connected to each lead-in wires 2 and 6 and extend parallel to the electrode 3. According to the invention, the wire probes 41 and 51 are supported by bimetallic or other temperature sensitive strips 4 and 5 which are electrically connected to the assigned lead-in wires 2 and 6. The bimetallic strips 4 and 5 as shown in full line in FIG. 1, indicate the position of the probe for starting. The probes 41 and 51 are in the back of the electrode 3, giving a small anode area for easy starting.

The position of the probe as indicated in FIG. 1 in dashed lines refers to the position during the lamp operation after ignition. The increased temperature due to ignition causes the bimetallic strips 5' and 4' to straighten out and move in front of the electrode 3, thereby increasing the effective area of the electrode 3; at the same time, the probes in the operative position affect the temperature of the probe to insure efficient operation and long life of the tube.

I wish it to be understood that I do not desire to be limited to the exact details of construction shown and described, for obvious modifications will occur to a person skilled in the art.

What I claim is

1. A discharge tube comprising two opposite electrodes, at least one wire probe located within said tube and electrically connected to each electrode, a temperature sensitive bimetallic support for each probe, said support being adjusted in its cool condition for placing said probe in a position remote from said electrode to reduce the effective area thereof for easy starting and, upon ignition of the discharge tube, in an operative position close to said electrode to increase the effective area thereof for affecting the operational temperature.

2. A discharge tube as claimed in claim 1, wherein each electrode is associated with two opposite wire probes extending substantially parallel with the electrodes.

* * * * *